US005848944A

United States Patent [19]

Brannen

[11] Patent Number: 5,848,944

[45] Date of Patent: Dec. 15, 1998

[54] PUTTING TRAINING METHOD

[76] Inventor: Thomas W. Brannen, 12485 Preserve La., Alpharetta, Ga. 30202

[21] Appl. No.: 929,405

[22] Filed: Sep. 15, 1997

[51] Int. Cl.[6] ..... A63B 69/36

[52] U.S. Cl. ..... 473/409; 473/220

[58] Field of Search ..... 473/220, 409

[56] References Cited

U.S. PATENT DOCUMENTS

| | | | |
|---|---|---|---|
| 3,070,373 | 12/1962 | Mathews et al. | 473/220 X |
| 3,953,034 | 4/1976 | Nelson . | |
| 5,165,691 | 11/1992 | Cook . | |
| 5,193,812 | 3/1993 | Hendricksen . | |
| 5,207,429 | 5/1993 | Walmsley et al. | 473/220 |
| 5,388,831 | 2/1995 | Quadri et al. . | |
| 5,388,832 | 2/1995 | Hsu . | |
| 5,435,562 | 7/1995 | Stock et al. . | |
| 5,452,897 | 9/1995 | Mick . | |
| 5,464,221 | 11/1995 | Carney . | |
| 5,464,222 | 11/1995 | Carney . | |
| 5,465,972 | 11/1995 | Cornett . | |
| 5,467,991 | 11/1995 | White et al. | 473/220 |
| 5,472,204 | 12/1995 | English et al. | 473/220 |
| 5,494,290 | 2/1996 | Stefanoski . | |
| 5,544,888 | 8/1996 | Pellegrini . | |

*Primary Examiner*—George J. Marlo
*Attorney, Agent, or Firm*—Jones & Askew, LLP

[57] ABSTRACT

A method for improving a golfer's putting technique so as to track a swing of the putter on a straight line parallel to a predetermined guide line while utilizing a putter having a handgrip connected to a club head by a shaft and wherein the club head incudes a face, the method including the steps of:

providing a straight guide line along a surface;

mounting a laser apparatus to the shaft of the putter;

aligning a beam of light from the laser apparatus in relation to the putter so as pass in transverse spaced-apart relation to the head of the putter and project a spot of light on the surface in vertical, spaced-apart relation to the head; and thereafter swinging the putter in a putting stroke motion while maintaining the beam of light in said alignment, thereby causing the spot of the light to track along a path parallel to the guide line.

4 Claims, 2 Drawing Sheets

PUTTING TRAINING METHOD

BACKGROUND OF THE INVENTION

1. Field of the Invention

This invention is directed to both a method and apparatus for teaching golfers to develop proper putting skills and, more particularly, to a method and apparatus for training golfers to develop a proper straight line swinging motion during a putting stroke. The invention incorporates a laser device which is adjustably mounted along the shaft of a putter so as to emit a coherent beam of light which may be appropriately adjusted relative to the face of the putter head so that a spot of light may be utilized to track parallel to, or along, a line which is provided by appropriate mark or elongated elements, such as tape or string so that the face of the putter head will be maintained perpendicular to the straight line utilizing the light spot as a visual guide during the putting stroke.

2. History of the Related Art

There have been many innovations developed for purposes of teaching golfers better putting skills. Many such training devices incorporate lasers which develop a coherent light beam which may be utilized to assist the golfer in properly aiming or directing a ball towards a cup or to a simulated hole on a practice surface.

In U.S. Pat. No. 5,193,812 to Hendricksen, a golf club laser alignment system is disclosed wherein a laser device is mounted directly to the head of a putter. The laser is powered by batteries which are mounted within the shaft of the putter and which are connected to the laser device on the putter head. In use, the alignment system allows a coherent beam of light to be directed from the central portion of the club in a straight line toward a simulated hole or an actual hole on a golf green. Unfortunately, with this type of device, substantial changes must be made to the putter to mount the laser system thereto. In a practical sense, the system cannot be used to retrofit existing putters and thus requires specialized putters to be manufactured and purchased for use with the alignment system. In addition, the alignment system only provides a straight line reference between a ball or simulated ball and a cup or simulated cup. Frequently, the direction of a putt is not in a straight line toward the hole on a green, but rather the putt will be made such that the ball will follow the course of the surface of the green in an arcuate manner to the hole. Other examples of putter alignment devices which incorporate laser systems and which require specialized putter structures are disclosed in U.S. Pat. No. 5,388,832 to Hsu and 5,464,221 and 5,464,222, both to Carney.

A variation of the above laser aiming systems is disclosed in U.S. Pat. No. 5,165,651 to Cook. In this patent, a laser golf club putter assembly is disclosed which also requires a specialized club to be utilized to house the laser alignment device and thus does not provide for an alignment system which may be adapted to a golfer's existing equipment. The patent discloses a pair of coherent light sources which are mounted within the putter head on opposite sides of the putter face. The lasers provide a pair of parallel coherent light beams which are directed on opposite sides of a ball toward a cup or hole on a golf green or on a simulated surface. Utilizing special glasses, the golfer is able to see the coherent light beams and direct the putt so that the ball is maintained between the parallel lines. This system also does not take into account that many putts require other than a straight line movement of the ball.

Another variation of laser putters is disclosed in U.S. Pat. No. 5,494,290 to Stefanoski. In this patent, a putter is specifically constructed to house a laser light source and a reflector is provided along the length of the shaft of the putter. As with the previously discussed aiming systems, this system also requires a specialized putter to be utilized and thus is not adapted for use with existing golf equipment. The device directs a coherent light beam from a midpoint of the shaft to the hole to provide an aiming point for directing a ball when making a putt.

U.S. Pat. No. 5,388,831 to Quadri et al. discloses an illuminated golf practice device which is designed to be mounted to a golfer's existing putter. This type of practice device has the benefit over previously discussed prior art laser aiming systems in that a golfer may utilize his/her own equipment and thereby develop proper putting techniques with the putter they will use during actual play. Further, such systems reduce the overall cost of the practice devices. In this patent, a light source in the form of a laser diode is mounted relative to a cylindrical lens secured to an arm which extends from a bracket attached to the shaft of a conventional putter. The cylindrical lens redirects the coherent light beam into a planar beam of light which is aligned to extend generally perpendicularly relative to the putter face toward a cup or simulated hole into which a golf ball is to be putted. As with other laser aiming devices, this type of training device only provides for a linear reference for aiming a ball toward a hole or simulated hole but does not otherwise teach the golfer proper swing techniques when putting the ball relative to a hole. A similar training device which is adapted to be mounted to existing putters is disclosed in U.S. Pat. No. 5,465,972 to Cronett.

In U.S. Pat. No. 3,953,034 to Nelson, a laser beam swing training device is disclosed which is not designed specifically for developing proper putting skills but which is designed to teach swing techniques for use with other golf clubs. The patent discloses a laser device which may be mounted so as to extend generally parallel to the shaft of an existing golf club and therefore does not require any modification to the shaft or handle portion of the golf club and thus may be adapted for use with existing equipment. However, the device does require that a modification be made to the head of a club. The device requires that a mirror be provided along the club head between the face and housel. The mirror is utilized to redirect a coherent beam of light issuing from the laser device forward of and generally perpendicularly to the club face. The device is utilized to indicate to a golfer that the head is properly aligned with a ball at the point of impact of a swing, however, the device does not otherwise teach or aid a golfer in developing proper putting motion and further requires a modification to existing equipment.

Other laser training devices for use with golfing equipment are disclosed in U.S. Pat. No. 5,452,897 to Mick and 5,544,888 to Pelligrini.

SUMMARY OF THE INVENTION

A method and apparatus for training golfers to develop proper straight line putting motion wherein the methodology includes adjustably mounting a laser apparatus along the shaft of a putter so that a coherent beam of light may be aligned generally along the length of the shaft and transversely relative to the sweet spot on the face of the putter so that a spot of light is developed generally perpendicularly and vertically spaced below the sweet spot at a point along the toe of the club face. A straight line is marked or otherwise provided by tape, string or the like along a putting or practice surface. The golfer practices putting strokes or swings by aligning the light spot so as to track either parallel to or along the length of the line which is provided, thus requiring the golfer to follow a straight line stroke motion.

The apparatus of the present invention includes a housing which is designed to be adjustably mounted to the shaft of a putter and in which is housed a laser device which emits a coherent light beam through an opening in one end of the housing. The laser is powered by batteries which are also contained within the housing and the housing is designed, in the preferred embodiment, to be snap-fitted by one or more opposing and generally C-shaped clamps directly to the putter shaft so that the apparatus may be placed into use or removed without the use of tools and without otherwise affecting the integrity and appearance of an existing putter.

The mounting clamp or clamps associated with the housing space the housing outwardly at a sufficient distance from the shaft so as to allow the rotation of the housing relative to the shaft to align a spot developed by the coherent light beam relative to the face of the putter head. Preferably, a spot is developed generally vertically aligned with the sweet spot of the putter head along the front face of the putter. In some instances, the light beam may be directed along the rear of the putter head. When mounted to the shaft of a putter and properly aimed with respect to the club head, the spot developed by the coherent light beam is utilized to track a straight line which is provided along a putting or practice surface.

It is the primary object of the present invention to provide a putting training aid which may be easily mounted to existing putters without the use of tools and which allows alignment of the training device to emit a coherent beam of light to a predetermined position relative to the face of the putter head so that a spot of light, or spots of light, may be utilized to track along, or parallel to, a straight line, mark or other indicator provided along a putting or practice surface to thereby assist in developing a putting stroke or swing in a straight line motion.

It is also the object of the present invention to provide a method for teaching golfers to develop better putting motions wherein the device may be utilized on a practice surface or on a golf course and wherein the device may be easily stored in a player's bag without interfering with other golf equipment and wherein the apparatus may be utilized without any modifications to a golfer's existing equipment.

It is also an object of the present invention to provide a method and apparatus for improving putting skills by providing an effective and economical device for learning proper straight line putting motions in the sport of golf.

DESCRIPTION OF THE PREFERRED EMBODIMENT

Figure 1:
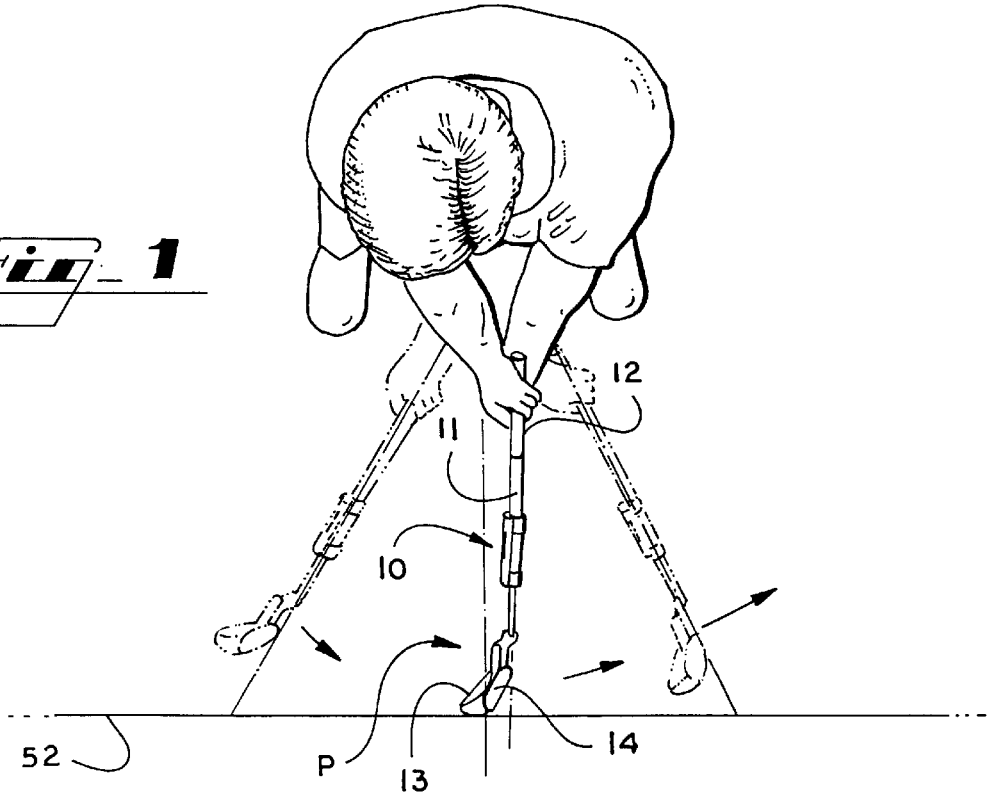
FIG. 1 is a top perspective illustrational view showing the alignment apparatus of the present invention mounted along the shaft of a putter having an offset club head and illustrating the manner in which a coherent beam of light is directed toward a straight line provided along the putting or practice surface during a putting motion.

With continued reference to the drawing figures, a laser putting practice device 10 is shown as being mounted along a portion of a shaft 11 below the handgrip 12 of a golf putter "P". The putter is provided with a head 13 having a front face 14 which is generally provided with an indication of a central sweet spot 15 which is the center of mass of the club head and the portion of the front face which is designed to impact the ball during a putting stroke so that no twist is imparted to the shaft during a putt.

Figure 3:
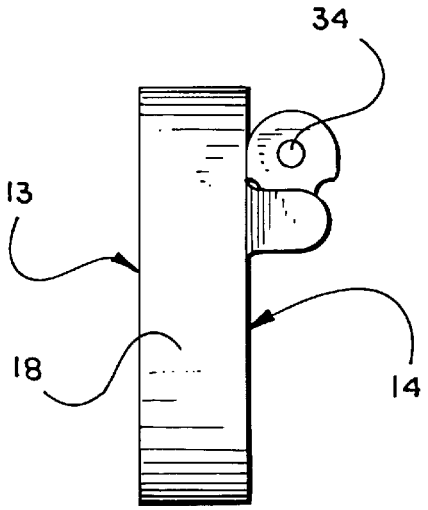
FIG. 3 is a bottom plan view of a putter having the practice device shown in FIG. 2 mounted thereto.

The club head 13 is connected through a hasel 16 to the base of the shaft 11. The club head includes a lower or toe surface 18, as shown in FIG. 3.

The laser alignment device includes a housing 20 which is somewhat cylindrical in cross-section and is preferably formed of plastic material which includes an upper end having a removable closure 22 by way of which access may be obtained to the interior of the housing. Mounted within the housing is an energy source such as batteries 24 and 25 which are electrically connected to a low power laser source 26 by way of a switch assembly 28. A switch assembly 28 is shown in the "ON" position in FIG. 4 whereby the laser generator 26 is activated to emit a coherent beam of light which is exemplified at 30 which forms a light spot 32 on a practice or putting surface. With specific reference to FIGS. 3 and 5, the coherent light beam issues through an opening 34 in the lower end of the housing 20.

Figure 4:
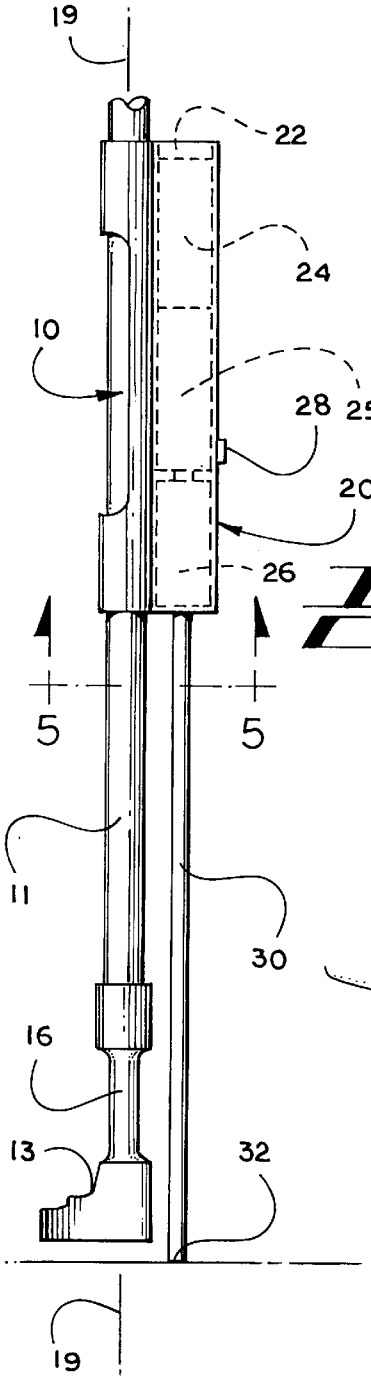
FIG. 4 is a side elevational view of the apparatus of the present invention shown mounted to the shaft of another putter and illustrating the path of a coherent light beam relative to the toe of the putter during use.
Figure 5:
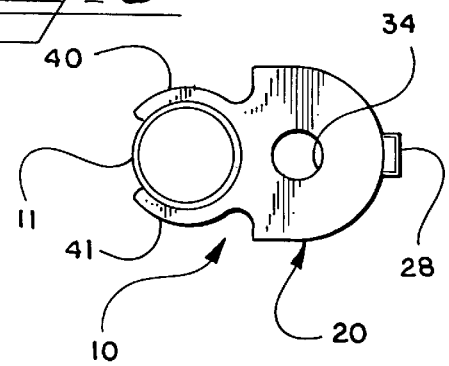
FIG. 5 is a cross-sectional view taken along line 5—5 of FIG. 4.

To selectively align the spot 32 generally vertically and perpendicularly below the sweet spot 15 of the club head 13, the housing includes pairs of opposing generally C-shaped clamps 40 and 41 which are spaced apart relative to one another at a distance so as to allow the shaft 11 of the putter to be inserted therebetween and retained by friction. In the embodiment shown, the clamping members 40 and 41 are integrally molded or formed with the housing 20. Further, in the preferred embodiment, two sets of clamping members 40 and 41 are disposed at each end of the housing, as shown in FIG. 4.

Figure 2:
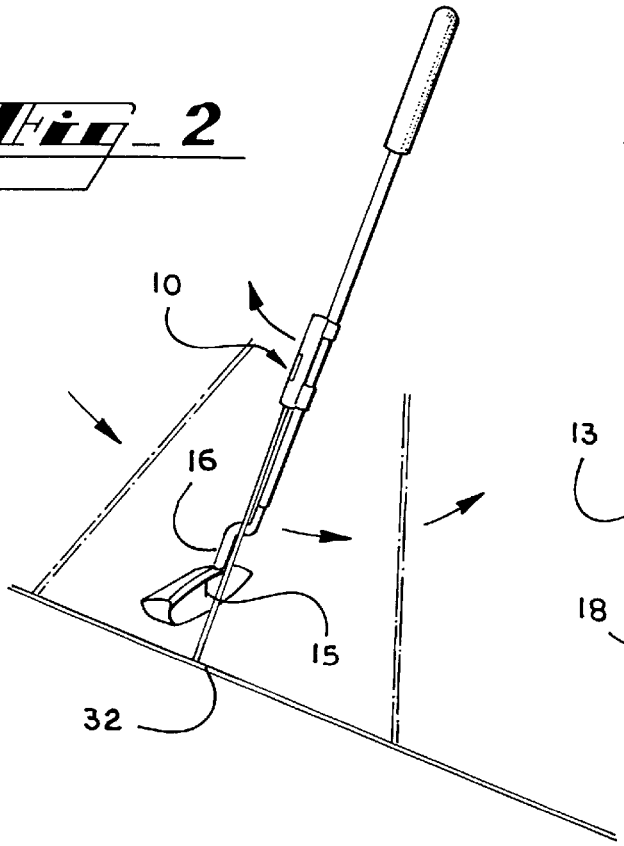
FIG. 2 is a perspective view of a golf putter having the practice device of the present invention mounted thereto and again illustrating the tracking of a straight line with a spot of light from a coherent light source during a putting stroke.

Utilizing the mounting clamps, the housing is disposed generally parallel to the axis A—A of shaft 11 of the putter. Further, the opening 34, through which the coherent beam of light 30 issues, is spaced generally parallel to the axis of the shaft. Once the housing has been mounted to the shaft 11, the housing is rotated such as shown by the arrow 50 in FIG. 2, to thereby align the spot 32 formed by the coherent light beam 30 vertically below the sweet spot 15 of the club heel. In the preferred embodiment, the club head is of the offset type so that the alignment of the coherent light beam 30 may be made generally universally with respect to any portion of the club face. However, and as shown in FIG. 4, putters having non-offset club heads may also be utilized with the alignment device 10 of the present invention.

With reference to FIG. 1, a line, string or tape 52 is applied in a straight line along the putting or practice surface. During the putting motion illustrated in FIG. 1, the spot 32 generated by the coherent light beam 30 is tracked along the length of the line 52 during the putting swing or stroke. This will ensure that the putting stroke is in a straight line and not an arc. Many golfers tend to swing a putter in an arcuate motion and not a straight line motion, and the present invention and methodology will ensure that proper putting techniques are developed to maintain a straight line putting stroke. With reference to the term "tracking" in the present application, the term refers to moving the club head so that the spot 32 developed by the coherent light source either follows the straight line 52 or parallels the straight line 52 during the putting motion.

Figure 6:
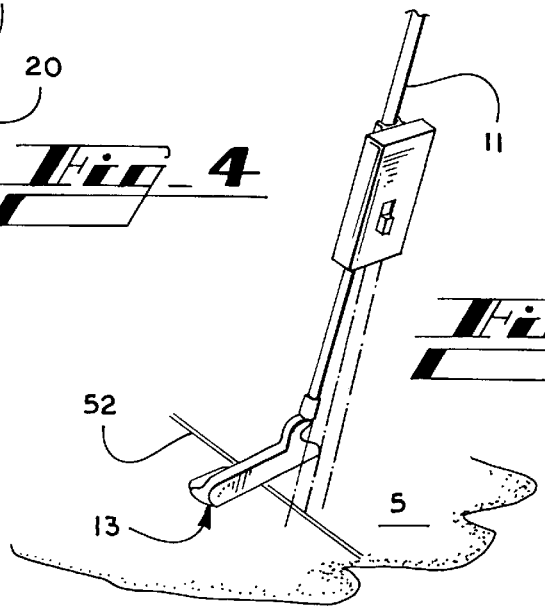
FIG. 6 is a partial perspective view of a second embodiment of the present invention which shows a plurality of coherent light beams issuing relative to the face of a golf putter head.
Figure 7:
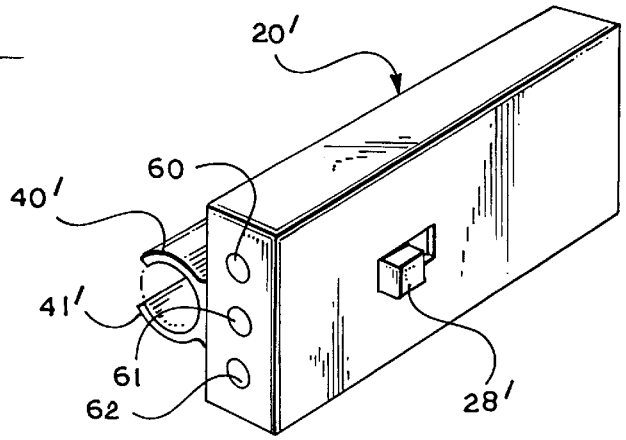
FIG. 7 is a perspective view of the embodiment shown in FIG. 6.

With respect to FIGS. 6 and 7, a separate embodiment of the invention is disclosed. In this embodiment, a plurality of light sources are provided within the housing 20'. In the embodiment, three separate openings are provided at 60, 61 and 62 in the lower end of the housing 20'. The housing further includes opposed C-shaped mounting members or brackets 40' and 41' which are used to mount the housing 20' to the shaft 11 of a putter. In this embodiment, a plurality of coherent laser generators such as the one disclosed at 26 with respect to the embodiment of FIGS. 1–5 are mounted within the housing 20' and are activated by an appropriate ON/OFF switch 28'. In the use of this embodiment, the three beams of light may be utilized to track along the line 52 which is applied by chalk, line or tape to the practice or putting surface, shown at "S" in FIG. 6.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A method for improving a golfer's putting technique so as to track a swing of the putter on a straight line parallel to a predetermined guide line while utilizing a putter having a handgrip connected to a club head by a shaft and wherein the club head includes a face, the method comprising the steps of:

providing a straight guide line along a surface;

mounting a laser apparatus to the shaft of the putter;

aligning a beam of light from the laser apparatus in relation to the putter so as to pass in transverse spaced-apart relation to the head of the putter and project a spot of light on the surface in vertical, spaced-apart relation to the head; and thereafter swinging the putter in a putting stroke motion while maintaining the beam of light in said alignment thereby causing the spot of light to track along a path parallel to the guide line.

2. The method of claim 1 wherein the path is co-extensive with the guide line.

3. The method of claim 1 including the initial step of aligning the spot of light vertically and in substantially perpendicular spaced-apart relation to a lower portion of the face of the putter with a sweet spot of the club head and in said transverse spaced-apart relation to the sweet spot, and thereafter maintaining that alignment while swinging the putter.

4. The method of claim 3 wherein the step of aligning includes rotating the laser apparatus in substantially parallel relation to the shaft of the putter.

* * * * *